US005181962A

United States Patent [19]

Hart

[11] Patent Number: 5,181,962

[45] Date of Patent: Jan. 26, 1993

[54] LIQUID SPRAY MACHINE FOR COATING INTERIOR OF PIPES

[75] Inventor: Milburn L. Hart, Tulsa, Okla.

[73] Assignee: Commercial Resins Company, Tulsa, Okla.

[21] Appl. No.: 817,365

[22] Filed: Jan. 6, 1992

[51] Int. Cl.[5] ..... B05C 7/00

[52] U.S. Cl. ..... 118/306; 118/37; 118/323; 118/DIG. 10

[58] Field of Search ..... 118/254, 306, 307, 313, 118/317, 323, DIG. 10, DIG. 11; 239/752; 134/172

[56] References Cited

U.S. PATENT DOCUMENTS 4,092,950 6/1978 Hart ..... 118/DIG. 10

*Primary Examiner*—W. Gary Jones
*Assistant Examiner*—Charles K. Friedman
*Attorney, Agent, or Firm*—William S. Dorman

[57] ABSTRACT

The invention is a spray machine for spraying liquid coating material onto the interior surface of a pipeline. The spray machine is provided with a movable frame which can be rolled on attached wheel assemblies through the pipeline and positioned with its spray gun pointing toward the interior pipe surface. The frame serves as a base to which the other parts of the spray machine attach. The spray gun and an attached hollow gun rotating shaft continuously rotate axially within the pipeline. When the spray gun is properly positioned, the spray gun is mechanically turned on and off by a cable attached to a gun actuating arm which is pivotally mounted on a bracket attached to the gun rotating shaft. The gun actuating arm is provided with a cam follower which travels in a rotating path against a movable cam plate assembly. The cam plate assembly is attached to and moved reardward by pistons of air actuated cylinders. When the cam plate assembly moves rearward, it pushes against the cam follower, causing the gun actuating arm to pivot and exert tension on the cable, turning the spray gun on. When air is released from the air cylinders, tension is released on the cable, turning the spray gun off. Liquid coating material is supplied to the spray gun via a rotary fluid coupling. The rotary fluid coupling allows liquid coating material to flow through the coupling while one half of the coupling remains stationary with relationship to the frame and the other half rotates with the spray gun and the gun rotating shaft.

9 Claims, 3 Drawing Sheets

LIQUID SPRAY MACHINE FOR COATING INTERIOR OF PIPES

BACKGROUND OF THE INVENTION

1. Field of the Invention

The present invention relates to a machine which can be pulled through and positioned within a pipe or pipeline by a commercially available internal pipe tractor and which is employed to spray liquid coating material onto the interior walls of the pipe or pipeline or onto the interior surfaces of girth welds of the pipe or pipeline.

2. The Prior Art

Preliminary searches were conducted on the invention disclosed herein, and the following patents were uncovered in the searches:

| Pat. No. | Inventor | Issue Date |
|---|---|---|
| 1,988,329 | A.G. Perkins | Jan. 15, 1935 |
| 2,158,579 | A.F. Hodgkins, et al. | May 16, 1939 |
| 3,017,855 | W.T. Ranker | Jan. 23, 1962 |
| 3,071,107 | R.C. Stanley | Jan. 1, 1963 |
| 3,753,766 | Brown, et al. | Aug. 13, 1973 |
| 4,092,950 | Hart | June 6, 1978 |
| 4,340,010 | Hart | July 20, 1982 |
| 4,938,167 | Mizuho, et al. | July 3, 1990 |

For pipelines constructed of metal which transport liquid material, contact with the liquid material causes corrosion to the internal surface of the pipeline. Even gas pipelines accumulate condensate which contacts the internal surfaces of the pipeline causing corrosion. To prevent this corrosive contact, pipes are usually coated at the factory with a protective coating. However, the pipe joints where the pipes are welded together, also known as girth welds, are not coated and must be coated after the pipeline is in place. Also, uncoated pipes must be coated to prevent corrosion.

Early devices for applying protective coating material to the inside of pipes consisted of means for centrifugally forcing the coating material onto the interior of the pipe and then troweling the coating material into place. One such device utilizing this means of application is shown in U.S. Pat. No. 1,988,329. One of the problems with this type of application is that the resulting coating is not uniform in thickness.

Another method for applying a protective coating material to the inside of pipes is shown in U.S. Pat. No. 2,158,579. Here the coating is brushed onto the inside of a pipe. Again, the brush bristles do not apply the material in a uniform manner and the resulting coating may have gaps and runs.

Other devices for applying coating materials simply sling the coating material radially outward against the pipe wall. Examples of these types of devices can be seen in U.S. Pat. No. 3,017,855, 3,071,107, 3,753,766 and 4,938,167. Again, the problem with these devices is that the thickness of the material on the pipe cannot be adequately controlled. The present invention utilizes a spray gun to apply the liquid coating material, thus providing a coating of more uniform thickness than previously achieved by other devices.

Mr. Robert J. Hart, a colleague of the present inventor, has two patents on internal pipe coating apparatuses, U.S. Pat. No. 4,092,950 and U.S. Pat. No. 4,340,010. In each of these patents, the material to be applied is a powder. Application is by arms or applicator heads which blow the powder onto the internal surface of the pipe. The present invention differs from these inventions in that it applies a liquid coating material using a spray gun.

Another problem with prior coating devices can be seen in U.S. Pat. No. 3,071,107. This patent utilizes packing seals to prevent leakage between a stationary source of coating material and a rotating nozzle which applies the coating to the interior of the pipe. Packing seals can leak or fail entirely as the rotating member wears against the seals. The present invention solves the problems of packing seal leakage and failure by conveying coating material from a stationary source to a rotating spray head utilizing a rotary fluid coupling capable of having one of its two ends remaining stationary while the other end rotates with the rotating spray gun.

Another problem with previous devices can be seen in U.S. Pat. No. 4,092,950. This device has a shaft which rotates but its rotation is actuated when the coating cycle is initiated. Stopping and resuming shaft rotation causes non-uniform thickness in the coating because the shaft is not rotating at a uniform speed during the entire spray cycle. The present invention solves this problem by continually rotating the shaft and spray gun and turning the spray gun off and on by means independent of the means for rotating the shaft and spray gun.

SUMMARY OF THE INVENTION

The present invention is directed to a spray machine for coating the interior of pipes or pipelines, either at girth welds or along the entire length of the pipe or pipeline. The invention has a front end and a rear end. The present invention is provided with a frame which serves as a supporting base for other parts of the spray machine, as a place of attachment for wheel assemblies on which the frame rolls, and as a place of attachment for hitches which attach to a means for moving the invention through the pipe.

A hollow gun rotating shaft is oriented with its longitudinal axis lying centered within the pipe and with one end of the gun rotating shaft extending through a bulkhead, said bulkhead attaching to the frame at the rear end. Means are provided for continuously rotating the gun rotating shaft.

A rotary fluid coupling having a stationary end and a rotating end is connected on the stationary end to a source of liquid coating material and connected on the rotating end to a rear connector. Said rear connector attaches to one end of a liquid coating tube having two ends; the other end of said liquid coating tube attaches to a spray gun.

The spray gun, the liquid coating tube, the rear connector, and the rotating end of the rotary fluid coupling all rotate continuously with the gun rotating shaft.

The frame is provided with an air compressor which provides air to air cylinders via an air tube, an air accumulating reservoir, and air lines. The air cylinders have pistons which push rearward a cam plate assembly on which a cam follower travels. Rearward movement of the cam follower causes an attached gun actuating arm to pivot on a bracket attached to the gun rotating shaft. The pivoting gun actuating arm puts tension on one end of an internal control cable having two ends. The other end of the internal control cable attaches to the spray gun which has been adapted to be activated by the internal control cable. The internal control cable serves to turn the spray gun on and off depending on whether tension is being placed on the internal control cable or not.

DETAILED DESCRIPTION OF THE PREFERRED EMBODIMENTS

Figure 1:
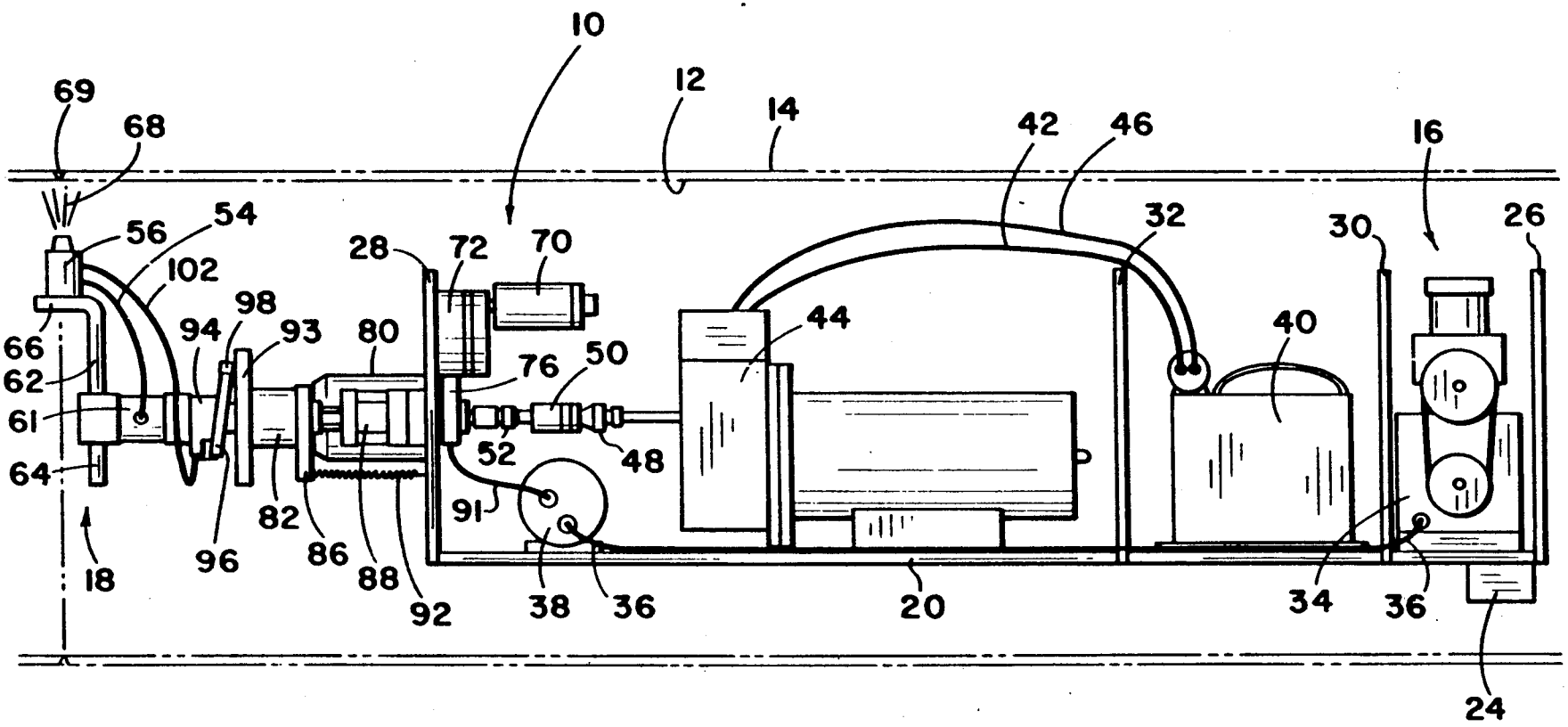
FIG. 1 is a side view of a spray machine made in accordance with the preferred embodiment of the invention.
Figure 2:
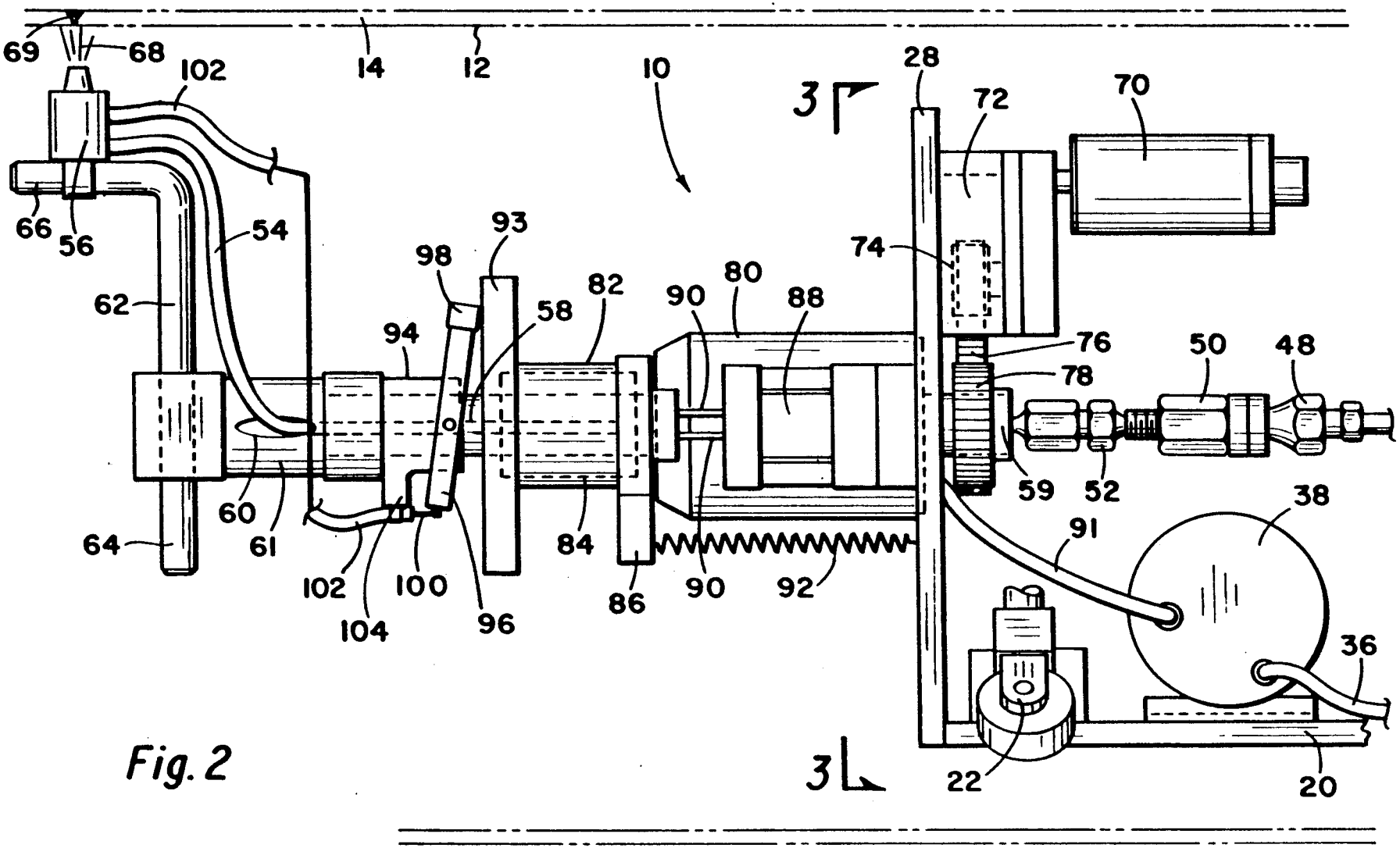
FIG. 2 is an enlarged side view of the rear portion of the spray machine shown in FIG. 1.
Figure 3:
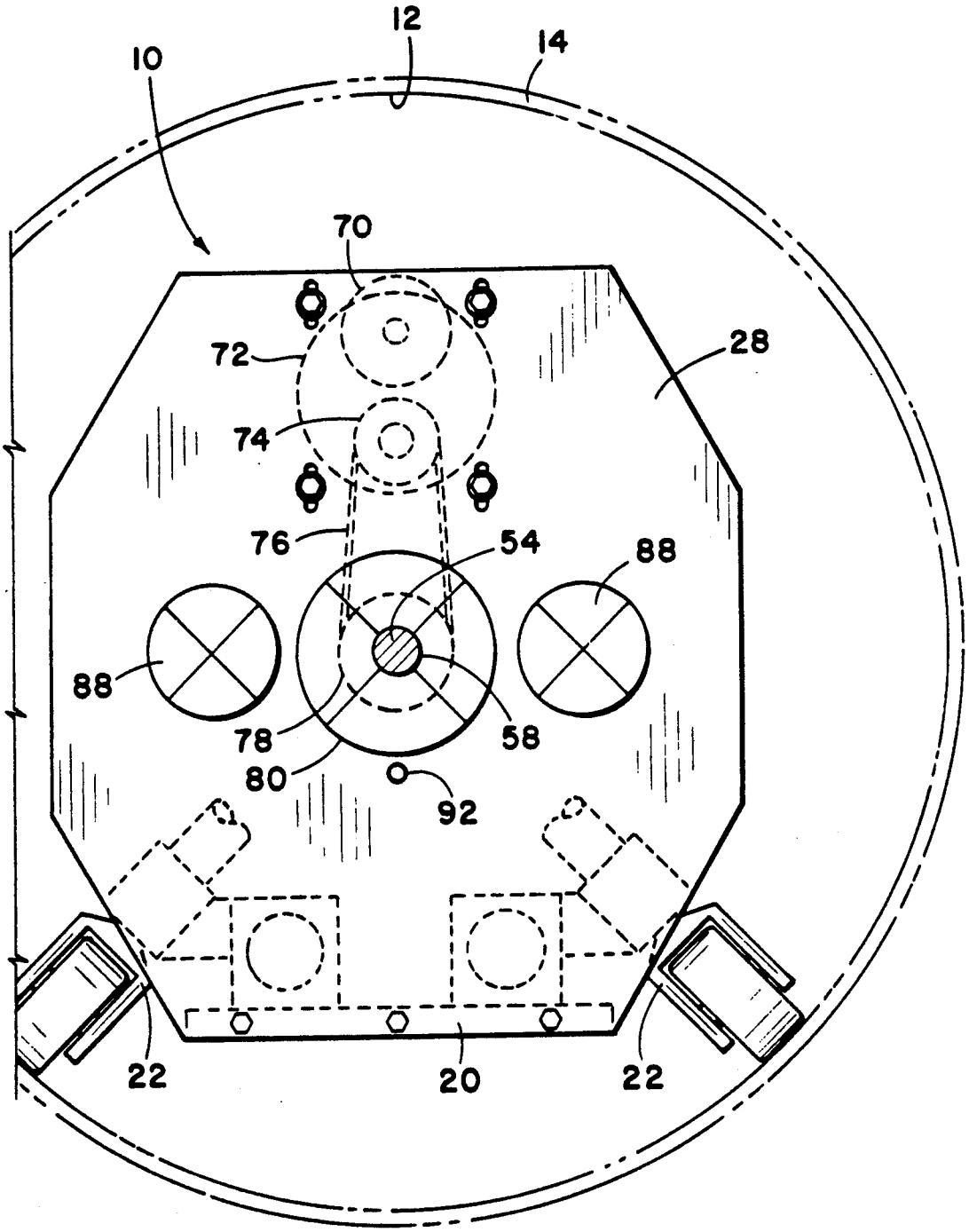
FIG. 3 is a cross-sectional view taken along line 3—3 of FIG. 2.

Referring now to FIG. 1, a spray machine, generally designated by numeral 10 is shown located resting on an inside surface 12 of a pipe 14. The spray machine 10 has a front end 16 and a rear end 18. The spray machine 10 is provided with a frame 20 to which standard caster wheel assemblies 22 attach at the rear end 18 and to which hitches 24 attach at the front end 16. Said wheel assemblies 22 contact the inside surface 12 of the pipe 14 and support the frame 20. Said hitches 24 provide a means of connecting the spray machine 10 to a commercially available internal pipe tractor (not shown). The internal pipe tractor (not shown) is capable of sending control signals to operate the spray machine 10.

The frame 20 is provided with a forward bulkhead 26 located at the front end 16 and a rear bulkhead 28 located at the rear end 18. The frame 20 is provided with a first upright divider 30 located between the forward bulkhead 26 and the rear bulkhead 28. The frame 20 is provided with a second upright divider 32 located between the first upright divider 30 and the rear bulkhead 28.

An air compressor 34 is attached to the frame 20 between the forward bulkhead 26 and the first upright divider 30. An air tube 36 having two ends attaches on one end to the air compressor 34 and on the other end to an air accumulating reservoir 38 which is attached to the frame 20 between the rear bulkhead 28 and the second upright divider 32 near the rear end 18.

A liquid coating material reservoir 40 is located between the first upright divider 30 and the second upright divider 32. The liquid coating material reservoir 40 may be a pre-made disposable tank or other suitable container. A sprayer tube 42 having two ends attaches by one end to the liquid coating material reservoir 40 and attaches by the other end to an airless spray pump 44; said airless spray pump 44 is attached to the frame 20 between the rear bulkhead 28 and the second upright divider 32 near the front end 16. A return line 46 having two ends attaches by one end to the airless spray pump 44 and attaches by the other end to the liquid coating material reservoir 40.

The airless spray pump 44 connects to a front connector 48, said front connector 48 attaches to a rotary fluid coupling 50 and said rotary fluid coupling 50 attaches to a rear connector 52. The rotary fluid coupling 50 has two halves. The first half which is attached to the front connector 48 is designed to remain stationary while the second half which is attached to the rear connector 52 is designed to rotate with the rear connector 52. A liquid coating tube 54 having two ends attaches on one end to the rear connector 52 and attaches on its other end to a spray gun 56. Said liquid coating tube 54 is enclosed within a hollow gun rotating shaft 58 from where the tube 54 connects to the rear connector 52 until the tube 54 exits the gun rotating shaft 58 at a slot 60. Said gun rotating shaft 58 has a front end 59 and a rear end 61. Said slot 60 is located near the rear end 61 of the gun rotating shaft 58. The front end 59 extends through the rear bulkhead 28. An "L" shaped bar 62, having a long leg 64 and a short leg 66, attaches by the long leg 64 to the rear end 61 of the gun rotating shaft 58, and said bar 62 attaches by the short leg 66 to the spray gun 56. Said spray gun 56 may be a Binks® or other suitable type spray gun. Said spray gun 56 is attached to the bar 62 so that spray 68 from the spray gun 56 is perpendicular to the inside surface 12 of the pipe 14 at a girth weld 69 or if the spray machine 10 is being used to coat the entire pipe 14, perpendicular to the inside surface 12 of the pipe 14.

A motor 70 attaches to a gear box 72 which is attached to the rear bulkhead 28 and located between the rear bulkhead 28 and the second upright divider 32. The gear box 72 is provided with a gear timing pulley 74 which is encircled by a timing belt 76. The timing belt 76 also encircles a shaft timing pulley 78 which attaches around the gun rotating shaft 58 on the front end 59 where the gun rotating shaft 58 extends through the rear bulkhead 28.

A bearing housing 80 attaches to the rear bulkhead 28 and extends toward the rear end 18 enclosing a portion of the gun rotating shaft 58. A cam plate assembly 82 is located adjacent to the bearing housing 80 on the rear end 18. Said cam plate assembly 82 contains an internal bushing 84 through which the gun rotating shaft 58 extends. The cam plate assembly 82 is provided with a forward plate 86 adjacent to the bearing housing 80.

Two single-acting air cylinders 88 are attached to the rear bulkhead 28 at positions located one on either side of the bearing housing 80. Said air cylinders 88 have pistons 90 extending toward the rear end 18. Said pistons 90 are attached to the forward plate 86. Air lines 91, having two ends, are connected on one end to the air accumulating reservoir 38 and on the other end to the air cylinders 88. When air from the air accumulating reservoir 38 is introduced into the air cylinders 88 via the air lines 91, the pistons 90 and the attached cam plate assembly 82 move toward the rear end 18 of the spray machine 10. A tension spring 92, having two ends, one end attaching to the forward plate 86 and the other end attaching to the rear bulkhead 28, pulls the cam plate assembly 82 toward the rear bulkhead 28 when air is released from the air cylinders 88. Said cam plate assembly 82 is provided with a rear actuating cam surface 93 facing the rear end 18.

A bracket 94 attaches to the gun rotating shaft 58 rearward of the cam plate assembly 82. A gun actuating arm 96, having two ends, is pivotally attached between its two ends to said bracket 94. One end of the gun actuating arm 96 is provided with a cam follower 98 which travels on the rear actuating cam surface 93. An internal control cable 100 having two ends is attached on one end to the other end of the gun actuating arm 96. The internal control cable 100 is attached on its other end to the spray gun 56 which has been adapted to be activated and de-activated by the internal control cable 100, serving to turn the spray gun 56 on and off. Said internal control cable 100 is enclosed by an external cable housing 102, having two ends, one end attached to an ear 104 on the bracket 94 and the other end attached to the spray gun 56.

Sufficient lengths of internal control cable 100 and external cable housing 102 are used in order to provide slack between where their ends attach. Likewise, a sufficient length of liquid coating tube 54 is used in order to allow slack between where its ends attach.

HOW THE INVENTION WORKS

The motor 70 continuously rotates the gun rotating shaft 58 and also rotates everything which is located rearward of the rotary fluid coupling 50 and which also is attached to the gun rotating shaft 58, i.e. the rotating half of the rotary fluid coupling 50, the rear connector 52, the liquid coating tube 54, the spray gun 56, the "L" shaped bar 62, the bracket 94 and the ear 104, the gun actuating arm 96 and the cam follower 98, the internal control cable 100 and the external cable housing 102.

Utilizing an internal pipeline tractor (not shown) the spray machine 10 is positioned so the spray gun 56 is aimed at the girth weld 69 of the pipe 14, or if the spray machine 10 is being used to coat the entire pipe 14, positioned so the spray gun 56 is aimed at the pipe 14. An operator triggers the spray gun 56 to turn on by sending a signal to introduce a volume of air from the air accumulating reservoir 38 to the air cylinders 88 via the air lines 91. The air forces the pistons 90 and the attached cam plate assembly 82 rearward. The cam follower 98 is pushed rearward by the rear actuating cam surface 93 on which it travels. When the gun actuating arm 96 pivots due to the rearward movement of the cam follower 98, this pivoting movement puts tension on the attached internal control cable 100. Tension on the internal control cable 100 triggers the spray gun 56 to spray liquid coating material. The liquid coating is provided to the spray gun 56 by the airless spray pump 44 via the front connector 48, the rotary fluid coupling 50, the rear connector 52, and the liquid coating tube 54.

To insure the liquid coating material remains mixed, a fresh supply of liquid coating material is continuously pumped to the airless spray pump 44 from the liquid coating material reservoir 40 via the sprayer tube 42. When the spray gun 56 is turned on, liquid coating material is returned from the airless spray pump 44 to the liquid coating material reservoir 40 via the return line 46. A stream of liquid coating material returning to the liquid coating material reservoir 40 through the return line 46 continually mixes the liquid coating material contained within the liquid coating material reservoir 40.

Whereas, the present invention has been described in particular relation to the drawings attached hereto, it should be understood that other and further modifications, apart from those shown or suggested herein, may be made within the spirit and scope of this invention.

What is claimed is:

1. A spray machine for spraying liquid coating material onto interior surfaces of a pipe at girth welds, the spray machine being movable longitudinally within the pipe comprising means for movably attaching a spray gun to the spray machine, means for continuously rotating the spray gun around the interior surface of the pipe, a rotary fluid coupling having a stationary end and a rotating end, the stationary end of the coupling being attached to a source of liquid coating material, the rotating end of the coupling being in fluid communication with the spray gun in order to supply liquid coating material to the spray gun so as to spray coating material onto the interior surface of the pipe, means for repeatedly interrupting the supply of liquid coating material from the rotary fluid coupling to the spray gun.

2. A spray machine according to claim 1 wherein the means for attaching the spray gun to the spray machine comprises a gun rotating shaft having a front end and a rear end, said front end being movably attached to the spray machine and said rear end having means for attaching the spray gun.

3. A spray machine according to claim 2 wherein the means for attaching the spray gun to the rear end of the gun rotating shaft comprises an "L" shaped bar with a short leg and a long leg, said long leg being attached to the rear end of the gun rotating shaft, said short leg being attached to the spray gun.

4. A spray machine according to claim 2 further comprising a shaft timing pulley attached to the gun rotating shaft as a means for continuously rotating the gun rotating shaft and spray gun, said shaft timing pulley encircled by and rotated by a timing belt, said timing belt encircling and rotated by a gear timing pulley, said gear timing pulley located in a gear box attached to a motor, said gear box and said motor attached to the spray machine.

5. A spray machine according to claim 1 wherein the source of liquid coating material attached to the stationary end of the rotary fluid coupling comprises a front connector attached to the stationary end of the rotary fluid coupling, said front connector attaching to an airless spray pump, a sprayer tube having two ends, one end of said sprayer tube attaching to a liquid coating material reservoir and the other end attaching to the airless spray pump through which liquid coating material continuously moves from the liquid coating material reservoir to the airless spray pump, a return line having two ends, one end of said return line attaching to the airless spray pump and the other end attaching to the liquid coating material reservoir through which liquid coating material returns to the liquid coating material reservoir from the airless spray pump when the spray machine is not spraying.

6. A spray machine according to claim 1 wherein the means for interrupting the supply of liquid coating material from the rotary fluid coupling to the spray gun comprises a cam plate assembly having an internal bushing through which the gun rotating shaft extends, said cam plate assembly provided with a forward plate attached to pistons of air cylinders, said air cylinders attached to the spray machine, an air supplying means attached to the air cylinders, means for returning the cam plate assembly to a forward position when air is released from the air cylinders, the cam plate assembly provided with a rear actuating cam surface, a bracket attached to the gun rotating shaft, a gun actuating arm pivotally attached to said bracket, said gun actuating arm having two ends, one end of said gun actuating arm having a cam follower which travels circularly adjacent to the rear actuating cam surface, the other end of said gun actuating arm attaching to one end of an internal control cable having two ends, the other end of said internal control cable being attached to the spray gun, said internal control cable being enclosed within an external cable housing having two ends, one end of said external cable housing being attached to the spray gun and the other end being attached to an ear on the bracket.

7. A spray machine according to claim 6 wherein the air supplying means for introducing air into the air cylinders comprises an air compressor, an air tube having two ends, one end of said air tube being attached to the air compressor and the other end being attached to an air accumulating reservoir, air lines having two ends, one end of said air lines being attached to the air reservoir and the other end being attached to the air cylinders.

8. A spray machine according to claim 7 wherein the means for returning the cam plate assembly to a forward position when air is released from the air cylinders comprises a tension spring with two ends, one end of said tension spring being attached to the spray machine and the other end being attached to the forward plate.

9. A spray machine for spraying liquid coating material onto internal surfaces of a pipe at girth welds, said spray machine having a front end and rear end, comprising a frame, means for moving and positioning the frame within the pipe, a rear bulkhead forming an end on the frame at the rear end, a rotary fluid coupling having a stationary end and a rotating end, the stationary end being attached to a source of liquid coating material and the rotating end being attached to a rear connector, said rear connector being attached to a liquid coating tube, said liquid coating tube being attached to a spray gun, said liquid coating tube extending through a gun rotating shaft from where the liquid coating tube connects to the rear connector to where the liquid coating tube exits the gun rotating shaft at a slot located near the rear end of the spray machine, said gun rotating shaft having a front end which extends through the rear bulkhead and a rear end extending to the rear end of the spray machine, means of attaching a spray gun to the rear end of the gun rotating shaft, the spray gun being aimed toward the internal surface of the pipe, means for continuously rotating the gun rotating shaft, a bearing housing attached to the rear bulkhead and extending toward the rear end of the spray machine through which the gun rotating shaft extends, a cam plate assembly adjacent to and located rearward of the bearing housing, said cam plate assembly having an internal bushing through which the gun rotating shaft extends, said cam plate assembly provided with a forward plate adjacent to the bearing housing, air cylinders with pistons being attached to the rear bulkhead so that the pistons extend rearward when air is introduced into the air cylinders from air supplying means, said pistons being attached to the forward plate of the cam plate assembly, means for returning the cam plate assembly to a forward position when air is released from the air cylinders, the cam plate assembly being provided rearwardly with a rear actuating cam surface, a bracket attaching to the gun rotating shaft rearward of the cam plate assembly, a gun actuating arm being pivotally attached to said bracket, said gun actuating arm having two ends, one end of said gun actuating arm having a cam follower which travels circularly adjacent to the rear actuating cam surface, the other end of said gun actuating arm being attached to one end of an internal control cable having two ends, the other end of said internal control cable being attached to the spray gun in order to turn the spray gun on and off, said internal control cable being enclosed within an external cable housing having two ends, one end of said external control housing being attached to the spray gun and the other end being attached to an ear on the bracket.

* * * * *